US008491110B2

(12) United States Patent
Muto

(10) Patent No.: US 8,491,110 B2
(45) Date of Patent: Jul. 23, 2013

(54) LIQUID EJECTING APPARATUS

(75) Inventor: Atsushi Muto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 13/361,813

(22) Filed: Jan. 30, 2012

(65) Prior Publication Data

US 2012/0200644 A1 Aug. 9, 2012

(30) Foreign Application Priority Data

Feb. 4, 2011 (JP) ..... 2011-022794

(51) Int. Cl.
*B41J 2/175* (2006.01)

(52) U.S. Cl.
USPC ..... 347/85

(58) Field of Classification Search
USPC ..... 347/84, 85, 86, 87
See application file for complete search history.

(56) References Cited

U.S. PATENT DOCUMENTS

| | | | | |
|---|---|---|---|---|
| 4,432,005 | A * | 2/1984 | Duffield et al. | 347/86 |
| 6,663,233 | B2 * | 12/2003 | Otsuka et al. | 347/85 |
| 7,404,628 | B2 * | 7/2008 | Naka et al. | 347/86 |
| 7,524,044 | B2 * | 4/2009 | Kumagai | 347/85 |

FOREIGN PATENT DOCUMENTS

| | | |
|---|---|---|
| JP | 2010-089477 | 4/2010 |
| JP | 2010-188590 | 9/2010 |

* cited by examiner

*Primary Examiner* — Anh T. N. Vo
(74) *Attorney, Agent, or Firm* — Workman Nydegger

(57) ABSTRACT

A liquid ejecting apparatus includes a liquid ejection head that reciprocates, a liquid supplying flow channel supplies a ink to the liquid ejection head, a non-return valve in the liquid supplying flow channel that opens when ink flows from an upstream region to a downstream region where the liquid ejection head is located and closes when ink flows from the downstream region to the upstream region, a volume changing unit that changes a volume of an inner space, and a stirring unit that stirs ink stored therein in accordance with the volume change of the volume changing unit, the stirring unit being disposed separately from the volume changing unit and they are disposed in the liquid supplying flow channel between the non-return valve and the liquid ejection head.

7 Claims, 7 Drawing Sheets

LIQUID EJECTING APPARATUS

BACKGROUND

1. Technical Field

The present invention relates to liquid ejecting apparatuses, and more specifically, to a configuration of liquid supplying flow channels through which liquid is supplied to liquid ejection heads.

2. Related Art

Generally, ink jet printers are widely known as a type of liquid ejecting apparatuses that eject liquid onto a medium. In these printers, printing is performed by ejecting ink (liquid) from ink cartridges (liquid storage containers) through nozzles which are formed on a liquid ejection head onto a medium (for example, sheet of paper). Recently, pigment ink has been sometimes used in these printers in order to achieve high-quality printing.

However, pigment ink has a problem in that pigment particles in the ink solvent settle out over time, resulting in uneven concentration of the pigment ink, thereby shades of the printed colors being slightly changed. In particular, when the pigment particles move through a long liquid supplying flow channel from the ink cartridge to the liquid ejection head, the sedimentation of pigment particles may occur in the liquid supplying flow channel. Accordingly, even if ink is stirred in the ink cartridge, it is difficult to prevent the color shades of pigment ink from being changed without reducing the unevenness in concentration of the pigment ink in the liquid supplying flow channel from the ink cartridge to the liquid ejection head.

JP-A-2010-188590 discloses a technique for stirring ink in the liquid supplying flow channel, in which a pressure and vacuum pump is used to generate a pressure variation inside the liquid supplying flow channel (passage), thereby causing a movable wall which is a part of the wall of the liquid supplying flow channel to be displaced. This displacement of the movable wall generates a flow of ink so that ink is stirred in the liquid supplying flow channel.

In the technique according to JP-A-2010-188590, however, the pressure and vacuum pump is provided as an additional device for generating a pressure variation in the liquid supplying flow channel so as to stir the ink, which may lead to large-sized printer or complicated configuration. Accordingly, a technique is needed for stirring ink in the liquid supplying flow channel without using an additional device.

SUMMARY

An advantage of some aspects of the invention is that a liquid ejecting apparatus capable of stirring the liquid in the liquid supplying flow channel between the liquid storage container and the liquid ejection head without providing any additional device is provided.

According to an aspect of the invention, a liquid ejecting apparatus includes a liquid ejection head that reciprocates and ejects a liquid therefrom, a liquid supplying flow channel that causes the liquid to move so as to supply the liquid to the liquid ejection head, a non-return valve that opens when the liquid flows from an upstream region to a downstream region where the liquid ejection head is located and closes when the liquid flows from the downstream region to the upstream region, the non-return valve being disposed in the course of the liquid supplying flow channel, a volume changing unit that changes a volume of an inner space in accordance with the movement of the liquid ejection head, the volume changing unit being disposed in the liquid supplying flow channel between the non-return valve and the liquid ejection head, and a stirring unit that stirs the liquid stored therein in accordance with the volume change of the inner space of the volume changing unit, the stirring unit being disposed in the liquid supplying flow channel between the volume changing unit and the non-return valve.

With this configuration, in the liquid supplying flow channel that supplies the liquid to the liquid ejection head, when the liquid ejection head is moved so as to change the volume of the inner space of the volume changing unit, the liquid stored in the stirring unit between the volume changing unit and the non-return valve can be stirred. Accordingly, the liquid which has been stirred can be supplied from the liquid supplying flow channel to the liquid ejection head without adding a special stirring device.

It is preferable that, in the liquid ejecting apparatus, the liquid ejection head is capable of moving between a medium ejection area in which the liquid is ejected from the liquid ejection head onto the medium and a non-medium ejection area other than the medium ejection area, and the volume changing unit changes the volume of the inner space of the volume changing unit when the liquid ejection head moves in the non-medium ejection area.

With this configuration, the volume of the volume changing unit can be changed and the liquid in the stirring unit of the liquid supplying flow channel can be stirred by using the movement of the liquid ejection head in the area other than the area in which printing is performed to the medium. If the volume of the volume changing unit is changed during ejection of the liquid onto the medium, a pressure variation occurs in the liquid supplying flow channel, which may leads to a change of the ejection amount. Accordingly, the liquid which has been stirred can be supplied from the liquid supplying flow channel to the liquid ejection head without affecting printing operation, since the volume is changed in the area which is different from the area in which printing is performed. In addition, the liquid can be selectively stirred.

It is preferable that, in the liquid ejecting apparatus, the stirring unit includes a movable wall that moves in accordance with the volume change of the inner space of the volume changing unit so as to change the volume of the liquid stored in the stirring unit.

With this configuration, the liquid can be thoroughly stirred in the stirring unit, since the volume of the liquid in the stirring unit can be changed with certainty in accordance with the movement of the movable wall.

It is preferable that, in the liquid ejecting apparatus, the movable wall is regulated so that the volume of the liquid stored in the stirring unit does not fall below a predetermined volume when the movable wall moves in a direction in which the volume of the liquid decreases.

With this configuration, the liquid can be effectively stirred, for example, in the stirring unit and the liquid which has been stirred can be reliably supplied to the liquid ejection head which is located downstream relative to the stirring unit in the liquid supplying flow channel.

It is preferable that the liquid ejecting apparatus further includes a biasing unit that biases the movable wall in a direction in which the volume of the liquid stored in the stirring unit decreases.

With this configuration, the movable wall that is biased by the biasing unit applies a pressure on the liquid in the stirring unit, thereby preventing the liquid from flowing from the upstream region into the stirring unit through the non-return valve. As a result, the liquid can be reliably stirred in the stirring unit, since the amount of the liquid that corresponds to the changed volume of the volume changing unit can flow into the stirring unit or flow out from the stirring unit.

It is preferable that the liquid ejecting apparatus further includes a check valve that prevents the liquid from flowing between the liquid ejection head and the liquid supplying flow channel when the volume of the inner space of the volume changing unit changes, the check valve being disposed in the liquid supplying flow channel.

With this configuration, even if a pressure of the liquid, for example, in the liquid supplying flow channel decreases in accordance with the volume change of the liquid supplying flow channel caused by the volume changing unit, the liquid in the liquid ejection head is prevented from being withdrawn into the upstream region. Further, even if a pressure of the liquid in the liquid supplying flow channel increases, the liquid is prevented from being excessively supplied to the liquid ejection head in the downstream region. Accordingly, printing onto the medium after the stirring operation can be performed in a stable manner.

It is preferable that, in the liquid ejecting apparatus, the volume changing unit has a bellows and the volume of the inner space of the volume changing unit changes when the bellows expands/collapses.

With this configuration, the liquid can be stirred in the stirring unit that is formed in the liquid supplying flow channel when the volume is changed by using the expansion/collapse of the bellows. Accordingly, the liquid which has been stirred can be supplied to the liquid ejection head without adding a special stirring device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
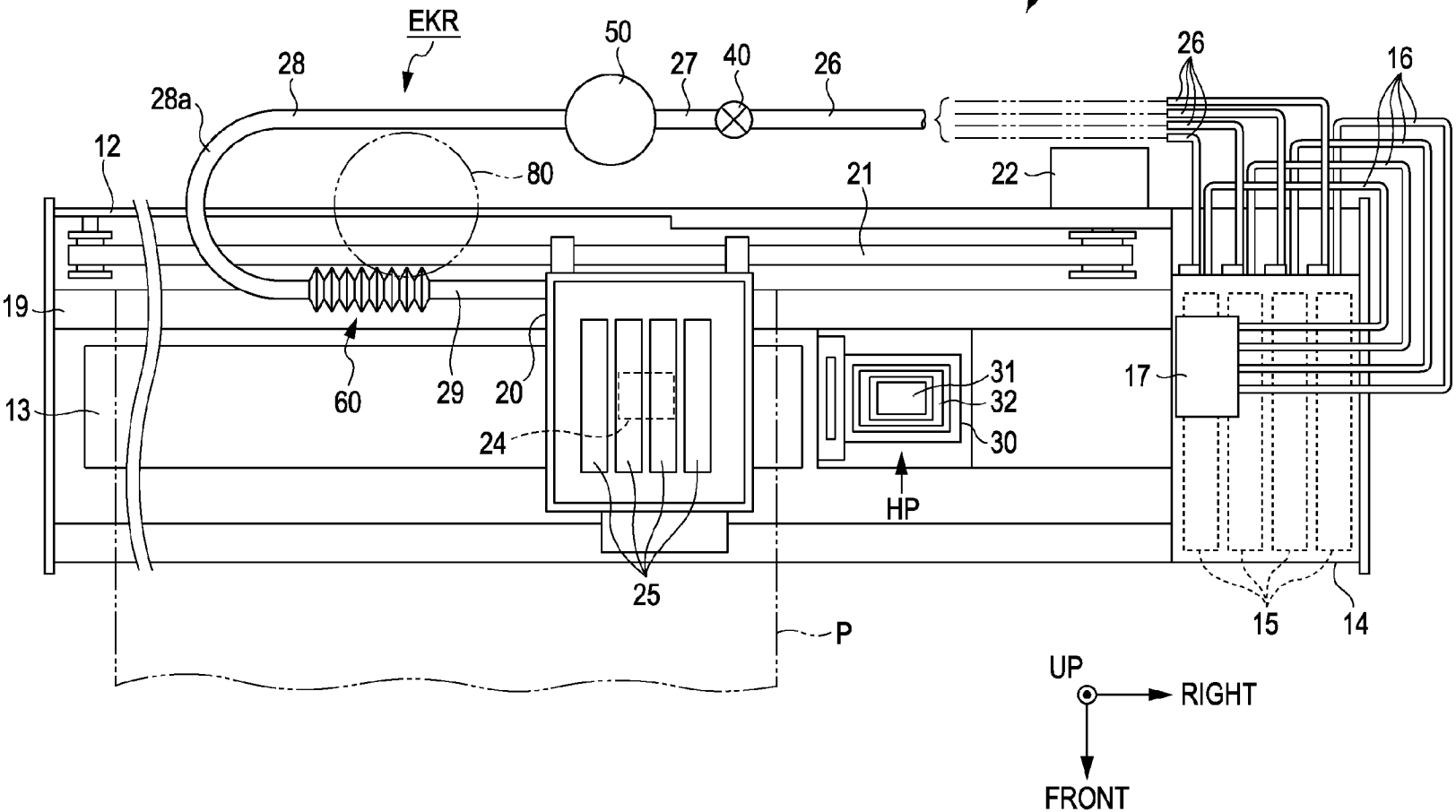
FIG. 1 is a schematic plan view of a configuration of a liquid ejecting apparatus according to an embodiment of the invention.

An embodiment of a liquid ejecting apparatus according to the present invention which is embodied as an ink jet printer (hereinafter also referred to as "printer") will be described below with reference to the drawings. For ease of explanation, the gravity direction and antigravity direction in the vertical axis as shown in FIG. 1 are defined as an up direction and a down direction, respectively. Further, in the direction orthogonal to the up-down direction, a transportation direction, in which a paper sheet P fed in the printer is transported during image forming, is defined as a front direction, while the direction opposite to the transportation direction is defined as a back direction. Further, the direction orthogonal to both the gravity direction and the transportation direction, in which a carriage 20 reciprocates, that is, a scan direction, is defined as a left-right direction as viewed from the front side.

As shown in FIG. 1, a printer 11 as an example of a liquid ejecting apparatus includes a frame 12 having a substantially rectangular box shape. A support member 13 that supports a medium such as the paper sheet P during printing is disposed at the lower position in the frame 12 and extends in the longitudinal direction (left-right direction) of the frame 12. The paper sheet P placed on the support member 13 is transported in the short-side direction (front direction) of the support member 13 by a drive of a sheet feeding motor (not shown in the figure) which is provided on the lower back side of the frame 12 with a sheet feeding mechanism (also not shown in the figure).

A cartridge holder 14 is disposed on one side (in this embodiment, right end) of the frame 12 in the scan direction, which is the longitudinal direction of the frame 12. A plurality of (in this case, four) ink cartridges 15 as an example of a liquid storage container that stores ink as an example of a liquid are detachably mounted in the frame 12. Further, a pressure pump 17 that supplies pressurized air via air supply tubes 16 to each of the ink cartridges 15 is disposed above the cartridge holder 14. In this embodiment, four ink cartridges 15 which are mounted in the cartridge holder 14 each contain different colors of pigment ink.

A guide shaft 19 is formed in the frame 12 so as to extend in the left-right direction, which is the scan direction, and supports a carriage 20 in a slidable manner. The carriage 20 is connected to a carriage motor 22 which is disposed at a position upstream in the transportation direction (on the back side of the frame 12) via a timing belt 21. The carriage 20 is configured to reciprocate along the guide shaft 19 in the left-right direction when driven by the carriage motor 22.

The carriage 20 is provided with a liquid ejection head 24 having a plurality of nozzles (not shown in the figure) formed on the underside so that ink is ejected therethrough and a plurality of valve unit 25 that correspond to the ink cartridges 15. The ink supplied from the respective ink cartridges 15 is pressurized by the pressure pump 17 and flows through liquid supplying flow channels EKR to the liquid ejection head 24.

Each liquid supplying flow channel EKR includes a first supply tube 26, a non-return valve 40, a second supply tube 27, a stirring unit 50, a third supply tube 28, a volume changing unit 60 and a fourth supply tube 29, in series from the side of the ink cartridges 15. These components communicate with each other while the first supply tube 26 and the fourth supply tube 29 communicate with the ink cartridge 15 and the carriage 20, respectively, such that ink flows therethrough. At least third supply tube 28 has a flexibility and is partially curved in a substantially semi-circular arc to form a curved portion 28*a* so as to orient the liquid supplying flow channel EKR in substantially the opposite direction. Accordingly, as the carriage 20 moves in the left-right direction, the position of the curved portion 28*a* moves in the left-right direction.

In this embodiment, all the liquid supplying flow channels EKR from the ink cartridges 15 to the carriage 20 have the same configuration, while at least the third supply tubes 28 are superposed in the up-down direction in plan view as seen from above as shown in FIG. 1.

In this configuration, ink flows from the ink cartridges 15 located upstream of the liquid supplying flow channels EKR to the carriage 20 located downstream of the liquid supplying flow channels EKR and is then supplied to the liquid ejection head 24 via the valve units 25 which are mounted on the carriage 20. When the liquid ejection head 24 is moved to an area where the liquid ejection head 24 faces the paper sheet P so as to eject ink onto the paper sheet P, which is called a medium ejection area, printing operation is performed to the paper sheet P by ejecting ink onto the paper sheet P.

The valve unit 25 has a valve mechanism (hereinafter also referred to as "self-sealing valve") that supplies ink from the liquid supplying flow channels EKR to the liquid ejection head 24 if a pressure inside the liquid ejection head 24 falls due to reasons such as the ink ejection from the nozzles during printing operation. That is, a pressure adjusting function is provided so that the pressure inside the liquid ejection head 24, which is a back pressure, is maintained at slightly negative relative to the atmosphere pressure outside the liquid ejection head 24, thereby forming an uniform meniscus in a plurality of nozzles and stabilizing the ink ejection operation.

A home position HP is provided in a non-medium ejection area outside the medium ejection area which is one side (in this embodiment, right end) of the range in which the carriage 20 moves in the scan direction in the frame 12. Further, a maintenance device 30 that performs various maintenance operations to the liquid ejection head 24 is disposed in the home position HP.

The maintenance device 30 includes a cap 31 formed in a bottom-closed box-like shape in a size that corresponds to the liquid ejection head 24 and a lifting mechanism 32 that moves the cap 31 upward and downward. The cap 31 is moved upward from the lower position so as to abut the liquid ejection head 24 which has been moved to the home position HP, thereby forming a closed space. Then, the closed space is kept under negative pressure by means of a suction pump, which is not shown in the figure, such that maintenance operation is performed to stabilize the ink ejection operation from the nozzles, for example, by suctioning the thickened ink through the nozzles.

In this embodiment, the carriage 20 is configured to move further in the right direction beyond the home position HP, where the cap 31 abuts the liquid ejection head 24, along the guide shaft 19 by a predetermined distance. Further, a projection 80 is formed on the inner surface of an upper case of the printer 11, which is not shown, so as to extend downward, such that the curved portion 28*a* of the third supply tube 28 abuts the projection 80 in the left-right direction when the carriage 20 reaches the home position HP. It should be noted that, all the curved portions 28*a* of the third supply tubes 28 for the four liquid supplying flow channels EKR that correspond to the four ink cartridges 15 abut the projection 80 in the left-right direction.

Figure 2:
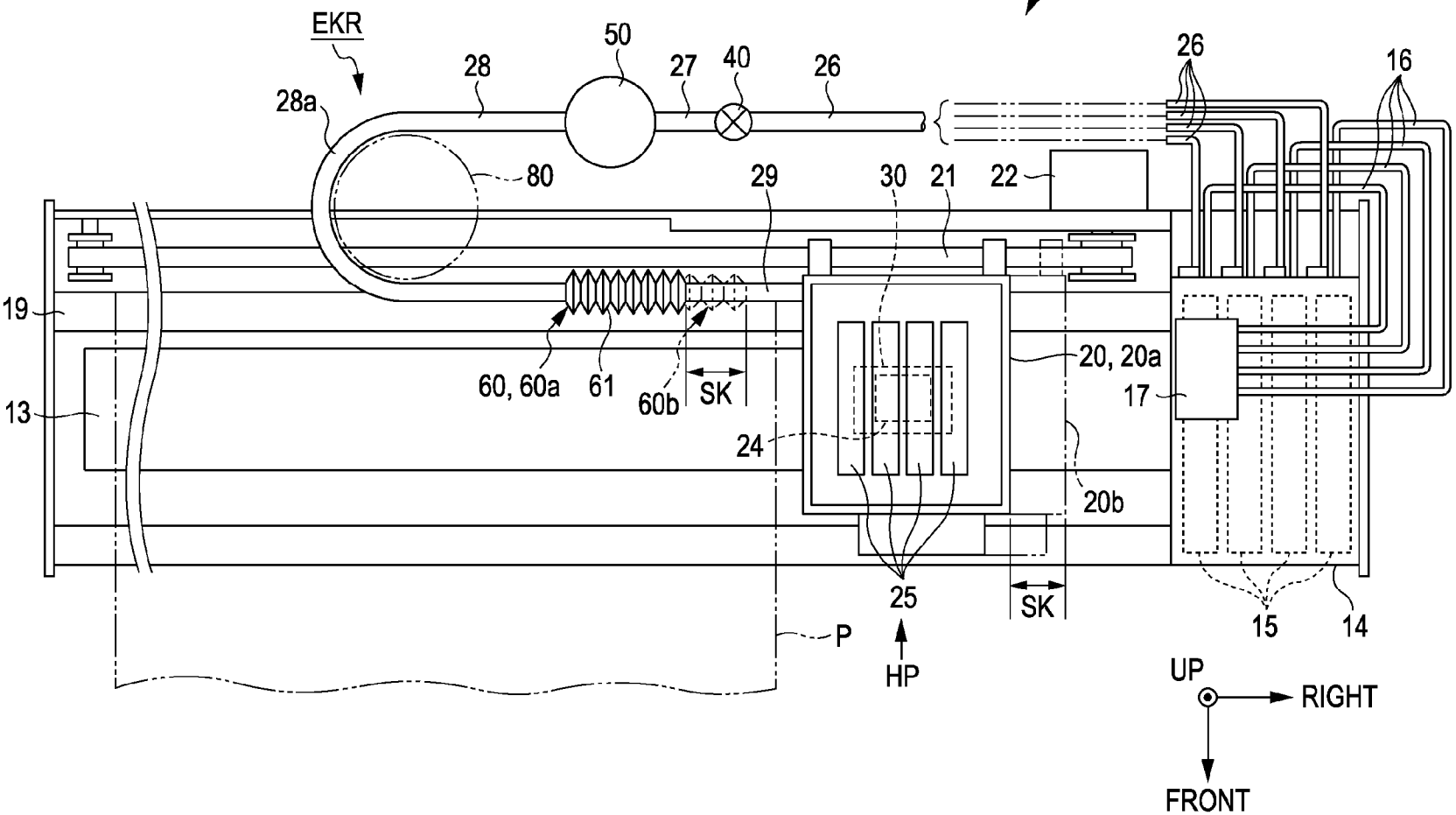
FIG. 2 is a plan view which shows the state when stirring of the liquid starts in the liquid ejecting apparatus according to the embodiment.

As shown in FIG. 2, when the carriage 20 moves in the right direction and reaches the home position HP indicated by a reference numeral 20*a*, the movement of the third supply tube 28 in the right direction is regulated by the abutment between the curved portion 28*a* and the projection 80. The carriage 20 is configured to move further from the home position HP in the right direction to a position indicated by a reference numeral 20*b* away from the projection 80 by a predetermined distance SK. As the carriage 20 moves, the volume changing unit 60 that is connected to the third supply tube 28 expands from the initial state (reference numeral 60*a* in FIG. 2) to the expanded state in which the volume changing unit 60 expands substantially by the movement distance SK of the carriage 20 as indicated by the dashed double-dotted line (reference numeral 60*b* in FIG. 2).

While the projection 80 is formed to prevent the curved portion 28*a* of the third supply tube 28 from moving in the right direction by abutting the curved portion 28*a*, the position of the projection 80 in the front-back and left-right directions, the outline of the projection 80 seen from above, and the extending amount of the projection 80 in the down direction are determined so as not to interrupt the reciprocating movement of the carriage 20 in the scan direction (left-right direction). The projection 80 of this embodiment has a cylindrical shape. Although the volume changing unit 60 in FIG. 1 is illustrated as engaging with the projection 80 in the front-back direction, the actual third supply tube 28 or the fourth supply tube 29 flexes forward such that the volume changing unit 60 is displaced in the front direction and does not engage with the projection 80. Accordingly, the volume changing unit 60 can smoothly move in the left-right direction.

In this embodiment, the volume changing unit 60 includes a bellows 61 that expands and collapses in the left-right direction. When the bellows 61 expands from the initial state, which is a collapsed state, the ink volume in the volume changing unit 60 increases, while the expanded bellows 61 collapses back to the initial state, the ink volume in the volume changing unit 60 decreases. The bellows 61 is made of an elastically deformable material (for example, elastic rubber) so that the bellows 61 in the expanded state returns by itself into the initial collapsed state when the carriage 20 moves from right to left to return to the home position HP. Alternatively, the bellows 61 may be provided with a bias member such as a coil spring so that the bellows 61 in the expanded state returns by itself into the initial collapsed state.

Figure 3A:
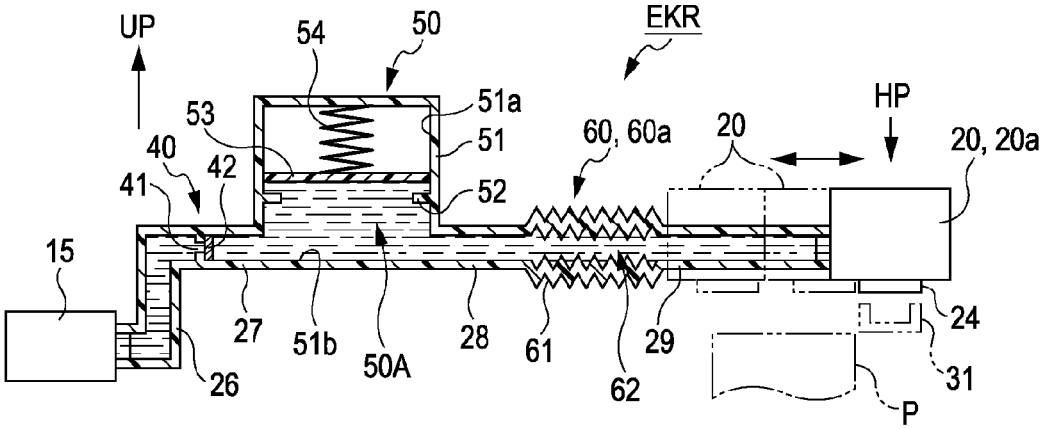
FIG. 3A is a schematic diagram of a stirring operation of the liquid ejecting apparatus according to the embodiment, showing a state before the stirring operation.
Figure 3B:
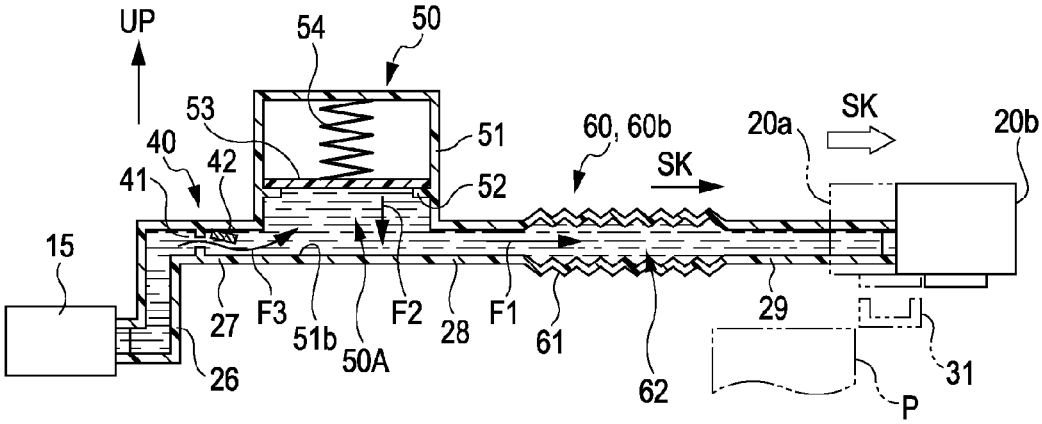
FIG. 3B is a schematic diagram of the stirring operation of the liquid ejecting apparatus according to the embodiment, showing a state when the volume of a volume changing unit increases to the maximum during the stirring operation.
Figure 3C:
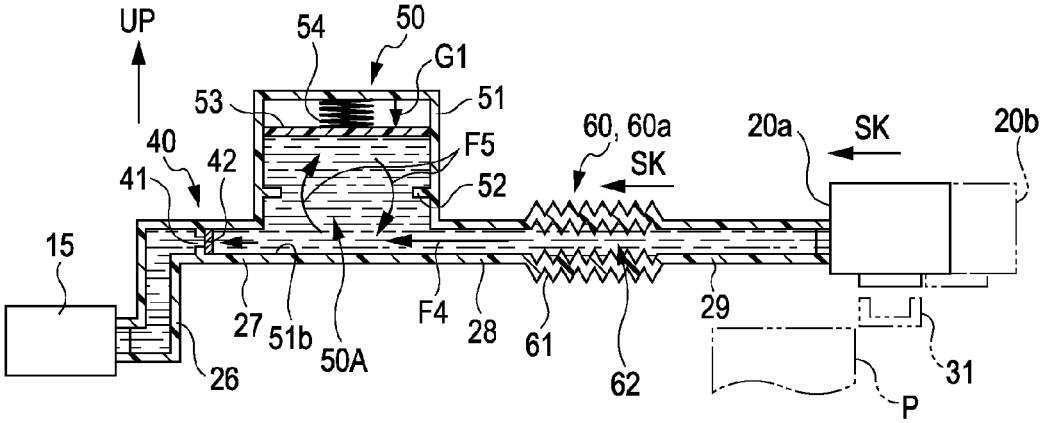
FIG. 3C is a schematic diagram of the stirring operation of the liquid ejecting apparatus according to the embodiment, showing a state when the volume of the volume changing unit decreases to the minimum during the stirring operation.

The printer 11 according to this embodiment is configured such that ink in the liquid supplying flow channel EKR can be stirred when the carriage 20 moves (reciprocates) between the home position HP and the position away from the home position HP in the right direction by the distance SK. That is, as shown in FIGS. 3A, 3B and 3C, a non-return valve 40 is disposed in the course of the liquid supplying flow channel EKR at a position upstream relative to the volume changing unit 60. The stirring unit 50 having a variable volume in which ink can be stored is disposed between the non-return valve 40 and the volume changing unit 60. As the volume of the volume changing unit 60 varies, the stirring unit 50 changes the ink volume inside the stirring unit 50, thereby stirring the ink (pigment ink).

Next, the ink stirring operation in the liquid supplying flow channel EKR will be described below with reference to FIGS. 3A, 3B and 3C. In this embodiment, all the liquid supplying flow channels EKR from the ink cartridges 15 to the carriage 20 (liquid ejection head 24) have the same configuration. Therefore, the ink stirring operation in one liquid supplying flow channel EKR will be described as a representative example. To simplify the explanation, the liquid supplying flow channel EKR is schematically illustrated in sectional view.

As shown in FIG. 1, the third supply tube 28 does not abut the projection 80 when the carriage 20 is located in the medium ejection area, i.e., a printing area, in which the carriage 20 faces the paper sheet P and within the area in which the carriage 20 moves from the end of the printing area to the home position HP. Accordingly, in these areas, the volume changing unit 60 moves in the left-right direction with the bellows 61 remaining collapsed as shown in FIG. 3A. In this state, for the stirring unit 50, an inner space 50A is formed in a stirring container 51 having a substantially cylindrical shape such that a predetermined amount of ink is stored in the inner space 50A. The inner space 50A is formed by an inner side wall 51*a* of the stirring container 51 having a cylindrical surface that extends in the up-down direction, an inner bottom wall 51*b* of the stirring container 51 and a movable wall 53.

The movable wall 53 which opposes the inner bottom wall 51*b* in the up-down direction is biased by a coil spring 54 as an example of a biasing unit in a direction toward the inner bottom wall 51*b*, that is, in a direction in which the volume of the inner space 50A decreases, while the periphery of the movable wall 53 remains in close contact with the inner side wall 51*a*. Further, in this embodiment, a rim-like projection 52 is formed on the inner side wall 51*a* of the stirring container 51 so as to radially inwardly project (that is, into the inner space 50A) and engage with the movable wall 53 when viewed from above. When the movable wall 53 moves downward and decrease the volume of the inner space 50A to a predetermined volume, the projection 52 regulates the movable wall 53 so as not to move in the down direction. Further, the second supply tube 27 and the third supply tube 28 are each connected to the stirring unit 50 at the lowest position of the stirring container 51. In addition, the non-return valve 40 has a so-called leaf valve configuration that opens/closes a flow channel port 41 by using a plate-like valve body 42.

Next, as shown in FIG. 3B, when the carriage 20 moves from the home position HP indicated by the reference numeral 20*a* in the right direction to the position indicated by the reference numeral 20*b* away from the medium ejection area by the predetermined distance SK, the volume changing unit 60 is pulled since the third supply tube 28 is regulated so as not to move in the right direction by abutting the projection 80. As a consequence, the bellows 61 of the volume changing unit 60 expands substantially by the distance SK, and accordingly, an inner space 62 of the volume changing unit 60 increases. This allows ink to flow from the third supply tube 28 into the inner space 62 whose volume is increasing, as indicated by the arrow F1 in the figure. Accordingly, the ink stored in the inner space 50A of the stirring unit 50 flows into the third supply tube 28. As the ink volume in the inner space 50A decreases, the liquid level lowers and the movable wall 53 moves downward as indicated by the arrow F2 in the figure. Meanwhile, a flow of ink occurs in the inner space 50A as ink flows into the third supply tube 28, which forces the pigment particles that have sedimented, for example, on the inner bottom wall 51*b* to move. As a result, ink is stirred in the stirring unit 50.

In this embodiment, the decreased volume of the inner space 50A of the stirring unit 50 due to the downward movement of the movable wall 53 from the position shown in FIG. 3A to the position shown in FIG. 3B, is smaller than the increased volume of the inner space 62 of the volume changing unit 60. In this state, after the movable wall 53 abuts the projection 52 and is regulated so as not to move downward, the volume of the inner space 62 of the volume changing unit 60 continuously increases. As the volume of the inner space 62 increases, the pressure in the liquid supplying flow channel EKR downstream of the non-return valve 40 becomes negative in principle. Consequently, the valve body 42 opens the flow channel port 41 of the non-return valve 40, and thus opens the non-return valve 40, thereby allowing ink to be supplied from the upstream region (where the ink cartridge 15 is located) to the downstream region as indicated by the arrow F3 in the figure, and accordingly, the inner space 62 of the volume changing unit 60 whose volume is increasing is filled with the ink. As a result, as ink flows from the second supply tube 27 into the inner space 50A of the stirring unit 50, ink is supplied to the stirring unit 50 while being stirred in the stirring unit 50.

Next, as shown in FIG. 3C, when the carriage 20 moves from the position indicated by the reference numeral 20*b* in the left direction to the home position HP indicated by the reference numeral 20*a* toward the medium ejection area by the predetermined distance SK, the bellows 61 of the volume changing unit 60 collapses substantially by the distance SK and returns to the initial state. As a result, the volume of the inner space 62 decreases to the initial state, thereby allowing ink to flow from the inner space 62 whose volume is decreasing via the third supply tube 28 into the inner space 50A of the stirring unit 50 as indicated by the arrow F4 in the figure.

As ink flows into the inner space 50A, the movable wall 53 moves upward and the volume of the inner space 50A of the stirring unit 50 increases. During the upward movement of the movable wall 53, a biasing force G1 is applied on the movable wall 53 since the movable wall 53 is biased downward by the coil spring 54. The biasing force G1 acts to depress the movable wall 53 which is moving upward, thereby constantly applying a pressure on the ink in the inner space 50A. This pressure acts to press the non-return valve 40 from the downstream to the upstream region so as to maintain the non-return valve 40 in the closed state, thereby preventing the ink that has flowed into the inner space 50A from being flowed out toward the region upstream of the non-return valve 40 and also prevents ink from flowing from the ink cartridge 15 (the upstream region) during the upward movement of the movable wall 53.

Accordingly, since the ink that has flowed from the third supply tube 28 into the inner space 50A forces the movable wall 53 to move upward and causes a flow of ink in the inner space 50A, ink is stirred in the stirring unit 50. During this ink stirring operation, the surface of ink remains in close contact with the movable wall 53, thereby preventing ruffles from being generated on the surface. As a result, ink is more likely to be thoroughly stirred since ink circulates in the inner space 50A, for example as indicated by the arrow F5 in the figure.

After the ink flowed (is supplied) from the upstream region into the inner space 50A as shown in FIG. 3B, the ink volume in the inner space 50A which is shown in FIG. 3C is larger than the ink volume in the inner space 50A which is shown in FIG. 3A. Accordingly, in this embodiment, when ink is supplied from the upstream region, the movable wall 53 can move in the up-down direction in accordance with the expansion and collapse of the bellows 61 of the volume changing unit 60 without being regulated.

That is, when a predetermined amount of ink is supplied from the upstream region into the inner space 50A, the movable wall 53 which is biased by the coil spring 54 constantly applies a pressure on the ink, thereby maintaining the non-return valve 40 in the closed state. Since the non-return valve 40 is maintained in the closed state, the amount of ink supplied from the upstream region to the inner space 50A is limited. For example, in the state shown in FIG. 3C in which the increased volume of ink is stored in the inner space 50A, when the bellows 61 expands and thus, the volume of the inner space 62 increases, the movable wall 53 becomes similar to that shown in the in FIG. 3B but does not abut the projection 52. In this state, ink in the inner space 50A remains to be pressurized by the coil spring 54. Since a force is applied on the valve body 42 from the downstream region to push the valve body 42 against the flow channel port 41, the non-return valve 40 is maintained in the closed state and ink is not supplied from the upstream region. Accordingly, the movable wall 53 can move upward without being regulated, until the bellows 61 collapses into the initial state.

As mentioned above, when the volume of the inner space 62 of the volume changing unit 60 increases and decreases by preventing ink from being supplied from the upstream region into the inner space 50A of the stirring unit 50, the movable wall 53 can move in the stirring unit 50 in accordance with the increase and decrease of the volume of the inner space 62 of the volume changing unit 60 without being regulated. As a result, even if the volume of the inner space 62 repeatedly increases and decreases in the volume changing unit 60, ink is thoroughly stirred by the movement of the movable wall 53 without being excessively supplied from the ink cartridge 15 to the stirring unit 50.

As a matter of course, when printing is performed by ejecting ink from the liquid ejection head 24 onto the paper sheet P, since ink is supplied from the liquid supplying flow channel EKR to the liquid ejection head 24, ink stored in the inner space 50A decreases from the state shown in FIG. 3C to the state shown in FIG. 3A. In this embodiment, when the volume of the inner space 50A becomes, for example, the volume shown in FIG. 3A, that is, when the ink stored in the stirring unit 50 becomes a predetermined amount, the carriage 20 is moved so as to expand/collapse the bellows 61, thereby supplying ink from the ink cartridge 15 to the stirring unit 50. Accordingly, the amount of ink stored in the inner space 50A of the stirring unit 50 is maintained to be the amount, for example, that is capable of supplying ink to the liquid ejection head 24 in a stable manner and of stirring ink in an effective manner.

In this embodiment, when the bellows 61 expands as shown in FIG. 3B and the volume of the inner space 62 increases, ink in the fourth supply tube 29 may be under negative pressure. In such a case, the above-mentioned valve mechanism (self sealing valve) of the valve unit 25 serves as a check valve that prevents the flow of ink, thereby preventing ink from flowing from the side of the liquid ejection head 24 to the upstream region in the fourth supply tube 29.

In addition, when the bellows 61 expands from the collapsed state as shown in FIG. 3B and the volume of the inner space 62 increases, ink in the fourth supply tube 29 may be, for example, under significant negative pressure. In such a case, if the negative pressure becomes larger than a force that closes the valve mechanism (self sealing valve) of the valve unit 25, ink flows back from the liquid ejection head 24 into the fourth supply tube 29 through the valve unit 25. In this embodiment, a check valve is provided so as to prevent ink from flowing back from the liquid ejection head 24 into the fourth supply tube 29. For example, although not shown in the figure, a check valve may be provided in the carriage 20 or the fourth supply tube 29 separately from the valve mechanism (self sealing valve) of the valve unit 25 so as to prevent ink from flowing back from the liquid ejection head 24 to the fourth supply tube 29 by closing the flow channel when the pressure in the fourth supply tube 29 falls below a predetermined negative pressure. Alternatively, a check valve may be provided so that the check valve operates when the volume of the inner space 62 of the volume changing unit 60 changes in order to prevent ink from flowing between the fourth supply tube 29 and the liquid ejection head 24.

According to the above-mentioned embodiment, the following effect can be obtained.

(1) In the liquid supplying flow channel EKR that supplies ink to the liquid ejection head 24, when the liquid ejection head 24 is moved so as to change the volume of the inner space 62 of the volume changing unit 60, ink stored in the stirring unit 50 in the liquid supplying flow channel EKR between the non-return valve 40 and the liquid ejection head 24 can be stirred. Accordingly, ink which has been stirred can be supplied to the liquid ejection head 24 without adding a special device (stirring device) such as a pressure and vacuum pump.

(2) The ink in the stirring unit 50 of the liquid supplying flow channel EKR can be stirred by using the movement of the liquid ejection head 24 in the area other than the area in which printing is performed by ejecting ink onto the paper sheet P. Accordingly, ink which has been stirred can be supplied from the liquid supplying flow channel EKR to the liquid ejection head 24 without affecting printing operation.

(3) The ink can be thoroughly stirred in the stirring unit 50, since the volume of the ink in the stirring unit 50 can be changed with certainty in accordance with the movement of the movable wall 53.

(4) The ink can be effectively stirred in the stirring unit 50 and the ink which has been stirred can be reliably supplied to the liquid ejection head 24 which is located downstream relative to the stirring unit 50 in the liquid supplying flow channel EKR, since the movable wall 53 is regulated so as not to move in the direction in which the volume of ink stored in the stirring unit 50 falls below a predetermined amount.

(5) The movable wall 53 that is biased by the coil spring 54 applies a pressure on the ink in the stirring unit 50, thereby preventing the ink from flowing from the upstream region into the stirring unit 50 through the non-return valve 40. As a result, ink can be reliably stirred in the stirring unit 50, since the amount of ink, for example, that corresponds to the changed volume of the inner space 62 of the volume changing unit 60 can flow into the stirring unit 50 or flow out from the stirring unit 50.

(6) Even if a pressure of the ink, for example, in the liquid supplying flow channel EKR decreases in accordance with the volume change of the inner space 62 of the volume changing unit 60, the ink in the liquid ejection head 24 is prevented from being withdrawn into the upstream region. Further, even if a pressure of the liquid in the liquid supplying flow channel EKR increases, the liquid is prevented from being excessively supplied to the liquid ejection head 24 in the downstream region. Accordingly, printing onto the paper sheet P after the stirring operation can be performed in a stable manner.

(7) The ink can be stirred in the stirring unit 50 that is formed in the liquid supplying flow channel EKR when the volume of the inner space 62 of the volume changing unit 60 is changed by using the expansion/collapse of the bellows 61. Accordingly, the ink which has been stirred can be supplied from the liquid supplying flow channel EKR to the liquid ejection head 24 without adding a special stirring device.

Figure 4A:
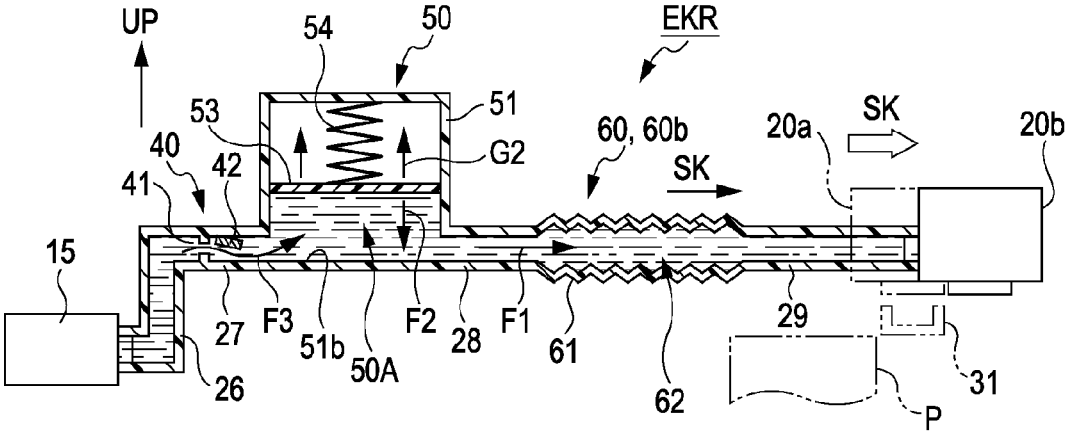
FIG. 4A is a schematic diagram of the stirring operation of the liquid ejecting apparatus according to the modified example, showing a state when the volume of a volume changing unit increases to the maximum during the stirring operation.
Figure 4B:
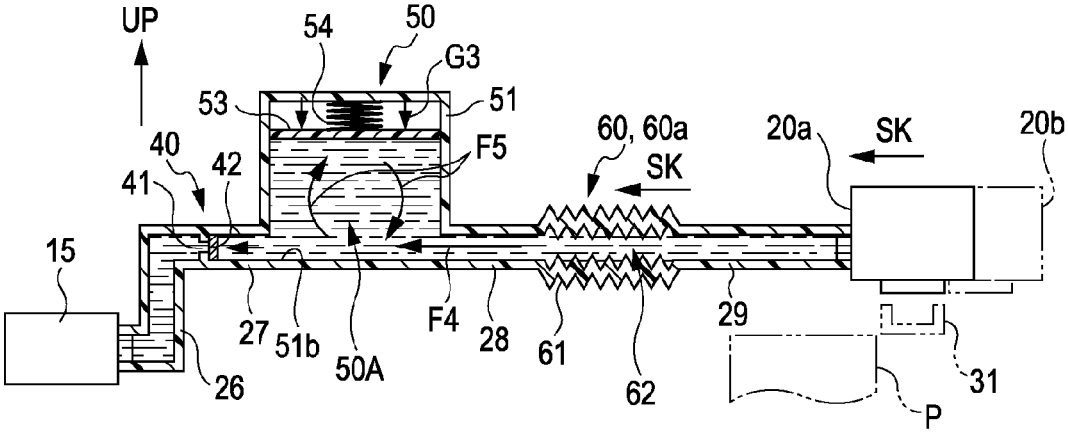
FIG. 4B is a schematic diagram of the stirring operation of the liquid ejecting apparatus according to the modified example, showing a state when the volume of the volume changing unit decreases to the minimum during the stirring operation.

The above-mentioned embodiment may be modified as follows:

In the above-mentioned embodiment, the projection 52 that regulates the movement of the movable wall 53 in the down direction may not be formed on the inner side wall 51*a* of the stirring container 51 of the stirring unit 50. The stirring operation according to this modified example will be described below with reference to FIGS. 4A and 4B. FIGS. 4A and 4B correspond to FIGS. 3B and 3C in the above-mentioned embodiment, respectively. In FIGS. 4A and 4B, the same numbers refer to the same components as those in the above-mentioned embodiment and will not be described further in detail.

According to this modified example, the coil spring 54 as an example of a biasing unit is disposed in the stirring unit 50 and has a length that satisfies spring properties in that the coil spring 54 generates a contraction force when it becomes longer than the standard length and a compression force when it becomes shorter than the standard length. Further, the upper end of the coil spring 54 is secured to the stirring container 51 and the lower end is secured to the movable wall 53.

According to this modified example, in the state where the bellows 61 has expanded to the maximum and the volume of the inner space 62 has increased as shown in FIG. 4A, when the movable wall 53 moves downward by a predetermined distance, the coil spring 54 generates a negative biasing force G2 that lifts the movable wall 53 upward. A negative pressure against the biasing force G2 is applied on the ink that is stored in the inner space 50A of the stirring unit 50 and is in close contact with the movable wall 53 so as to move the movable wall 53 in the direction indicated by the arrow F2 in the figure.

Then, the generated negative pressure acts to open the non-return valve 40 so that ink is supplied from the ink cartridges 15 to the inner space 50A of the stirring unit 50 through the non-return valve 40 as indicated by the arrow F3 in the figure. The ink is continuously supplied from the ink cartridges 15 until the movable wall 53 reaches the position in which the biasing force G2 that moves ink upward is no longer generated, in other words, the coil spring 54 becomes the standard length. As a result, ink flows from the second supply tube 27 into the inner space 50A of the stirring unit 50, thereby supplying ink to the stirring unit 50 while stirring ink in the stirring unit 50 in the same manner as that of the above-mentioned embodiment.

After that, as the bellows 61 of the volume changing unit 60 collapses into the initial state and the volume of the inner space 62 decreases to the minimum as shown in FIG. 4B, ink flows from the volume changing unit 60 into the inner space 50A of the stirring unit 50 and forces the movable wall 53 to move upward in the same manner as that of the above-mentioned embodiment. Then, the coil spring 54 becomes shorter than the standard length such that the coil spring 54 generates a positive biasing force G3 that acts to depress the movable wall 53 which is moving upward and applies a force on the ink in the inner space 50A. Due to this pressure, the ink which has flowed into the inner space 50A maintains the non-return valve 40 in the closed state during the upward movement of the movable wall 53 in the same manner as that of the above-mentioned embodiment, and accordingly, ink is prevented from flowing into from the ink cartridge 15.

As the ink in the inner space 62 of the volume changing unit 60 flows through third supply tube 28 into the inner space 50A of the stirring unit 50 as indicated by the arrow F4 in the figure, ink flows within the stirring unit 50, and accordingly, ink is stirred in the stirring unit 50. During this ink stirring operation, the surface of ink remains in close contact with the movable wall 53, thereby preventing ruffles from being generated on the surface. As a result, ink circulates in the inner space 50A, for example as indicated by the arrow F5 in the figure, and is more likely to be thoroughly stirred.

According to the above-mentioned modified example, the following effect can be obtained in addition to the effect described in (1) to (7).

(8) The need of providing the projection 52 in the stirring container 51 can be eliminated by using both the contraction force caused by the expansion of the coil spring 54 and the compression force caused by the compression of the coil spring 54. Accordingly, the configuration of the stirring unit 50 can be simplified.

In the above-mentioned embodiment and the modified example, the biasing unit such as the coil spring 54 and the movable wall 53 may not be used. For example, in the above-mentioned modified example, a part of the stirring container 51 may be formed of a flexible member which is elastically deformable so that the flexible member serves as the movable wall 53, and the restoring force generated during elastic deformation of the flexible member may serve as the biasing unit.

Figure 5A:
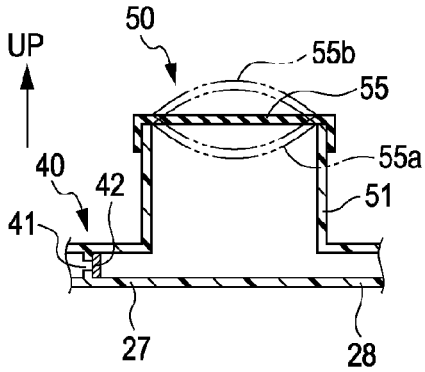
FIG. 5A is a view of a stirring unit according to another modified example, in which a movable wall and a biasing unit are not separately provided, showing a sectional view of a configuration of the stirring unit.
Figure 5B:
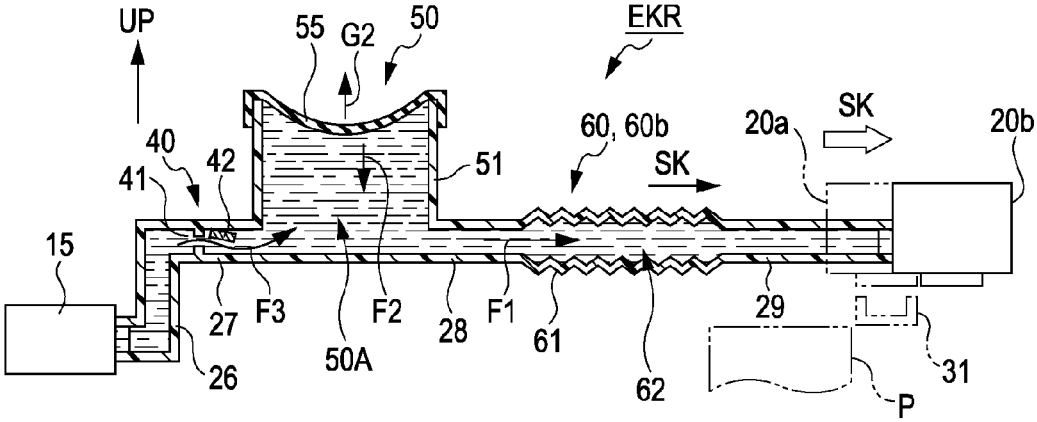
FIG. 5B is a view of the stirring unit according to another modified example, in which the movable wall and the biasing unit are not separately provided, showing a state when the volume of a volume changing unit increases to the maximum during the stirring operation.
Figure 5C:
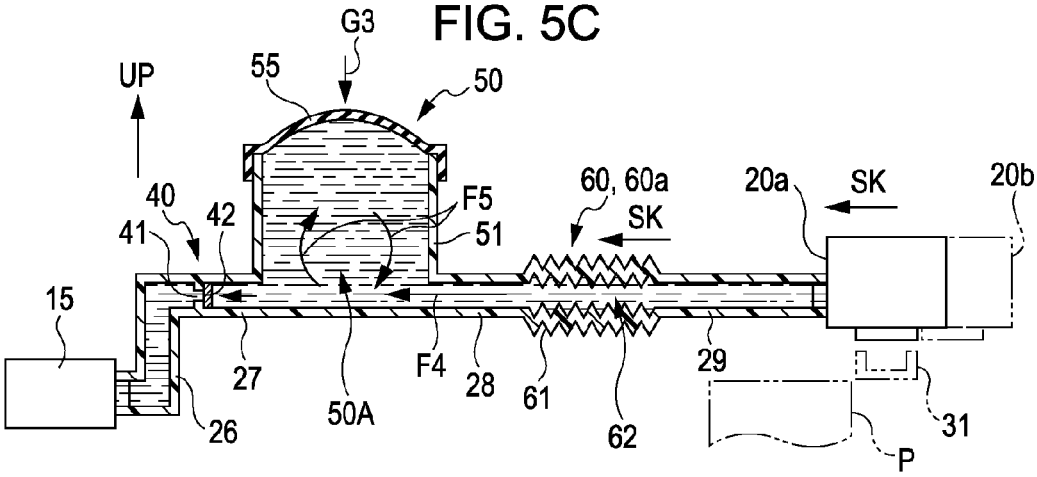
FIG. 5C is a view of the stirring unit according to another modified example, in which the movable wall and the biasing unit are not separately provided, showing a state when the volume of the volume changing unit decreases to the minimum during the stirring operation.

This modified example will be described below with reference to FIGS. 5A to 5C. FIGS. 5B and 5C correspond to FIGS. 4A and 4B in the above-mentioned embodiment, respectively. In FIGS. 5A to 5C, the same numbers refer to the same components as those in the above-mentioned embodiment and the modified example, and will not be described further in detail.

According to this modified example, the upper end of the stirring container 51 is open and a flexible member 55 made of an elastic material, such as elastic rubber and elastomer, is mounted on the stirring container 51 so as to cover the opening as shown in FIG. 5A. More specifically, the flexible member 55 is bonded at its periphery to the opening of the stirring container 51 at its opening edge by using adhesive or the like so as to seal the opening. The flexible member 55 is elastically deformable in the up-down direction into a concave shape as shown by the reference numeral 55*a* and into a convex shape as shown by the reference numeral 55*b*. The flexible member 55 can operate similarly to the movable wall 53 in the above-mentioned modified example in the stirring unit 50 by using such elastic deformation so as to stir the ink in the stirring unit 50. This stirring operation will be described below with reference to FIGS. 5B and 5C.

As shown in FIG. 5B, when the bellows 61 expands and the inner space 62 of the volume changing unit 60 increases to the maximum as indicated by the reference numeral 60*b*, ink flows from the inner space 50A of the stirring unit 50 into the inner space 62 of the volume changing unit 60, which forces the flexible member 55 to bend downward and elastically deform into a concave shape. This elastic deformation causes the flexible member 55 to generate a restoring force that acts to restore itself into the initial non-deformed state (for example, the state shown by the reference numeral 55*a* in FIG. 5A), thereby generating a negative biasing force G2 which moves the ink upward.

Accordingly, a negative pressure against the biasing force G2 is applied on the ink that is stored in the inner space 50A of the stirring unit 50. The generated negative pressure acts to open the non-return valve 40 so that ink is supplied from the ink cartridges 15 to the inner space 50A of the stirring unit 50 through the non-return valve 40 as indicated by the arrow F3 in the figure. As a result, ink continuously flows from the second supply tube 27 into the inner space 50A of the stirring unit 50 until the flexible member 55 returns (moves upward) to the initial state, thereby supplying ink to the stirring unit 50 while stirring ink in the stirring unit 50.

As shown in FIG. 5C, when the carriage 20 moves to the home position HP indicated by the reference numeral 20*a* away from the position indicated by the reference numeral 20*b*, the bellows 61 of the volume changing unit 60 collapses substantially by the distance SK into the initial state. As a result, the volume of the inner space 62 decreases to the initial state in the same manner as that of the above-mentioned embodiment, thereby allowing ink to flow from the inner space 62 whose volume is decreasing via the third supply tube 28 into the inner space 50A of the stirring container 51 as indicated by the arrow F4 in the figure.

Accordingly, the flexible member 55 is forced to elastically deform upward. This elastic deformation causes the flexible member 55 to generate a restoring force that acts to restore itself into the initial non-deformed state, and accordingly, generates a positive biasing force G3 which moves the ink downward and applies a pressure on the ink in the inner space 50A. This pressure acts to constantly maintain the non-return valve 40 in the closed state during elastic deformation of the flexible member 55, thereby preventing the ink that has flowed into the inner space 50A from being flowed out toward the region upstream of the non-return valve 40 and also preventing ink from being flowed from the ink cartridge 15.

Since the amount of ink corresponding to the changed amount of the inner space 62 of the volume changing unit 60 flows into the inner space 50A of the stirring unit 50, the flowed ink forces the flexible member 55 to bend upward and causes a flow of ink to stir the ink in the inner space 50A. According to this modified example, the surface of ink remains in close contact with the flexible member 55 during this ink stirring operation, thereby preventing ruffles from being generated on the surface. As a result, ink is more likely to be thoroughly stirred since ink circulates in the inner space 50A, for example as indicated by the arrow F5 in the figure.

It should be noted that the surface of ink according to this modified example may not be in close contact with the flexible member 55, and for example, air may be interposed therebetween. Although ruffles may be generated on the surface of ink to the air layer in some cases, it is not to mention that ink stirring operation may be obtained. In this case, the flexible member 55 serves as a biasing unit that pressurizes and depressurizes ink via the air layer.

According to the above-mentioned modified example, the following effect can be obtained in addition to the effect described in (1) to (7).

(9) Since the function of the movable wall 53 or the biasing unit may be shared by a member of the stirring container 51, the configuration of the stirring unit 50 can be simplified.

In the above-mentioned embodiment and the modified example, the volume changing unit 60 may be formed by the configuration other than the bellows 61. This modified example will be described below with reference to FIGS. 6A, 6B and 7.

Figure 6A:
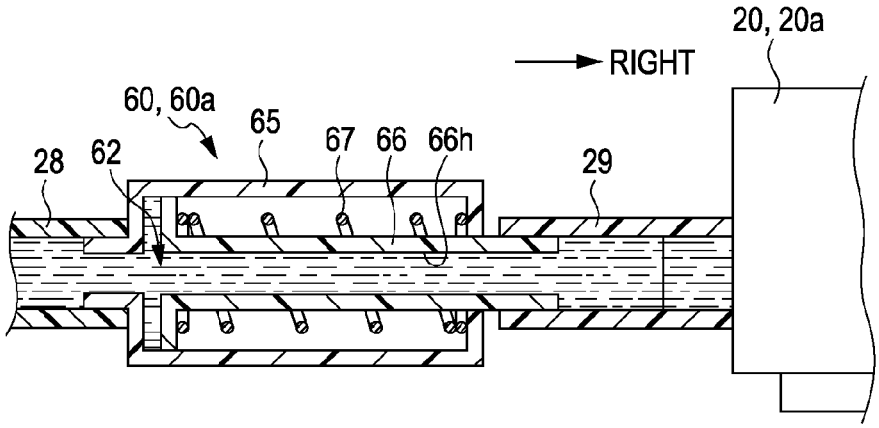
FIG. 6A is a sectional view of a modified example of a volume changing unit, showing a state when the volume of the volume changing unit decreases to the minimum during the stirring operation.
Figure 6B:
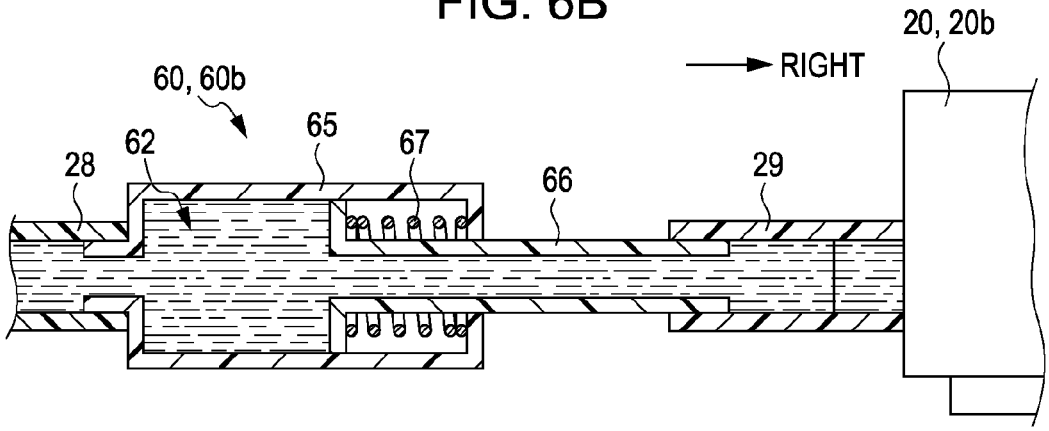
FIG. 6B is a sectional view of the modified example of a volume changing unit, showing a state when the volume of the volume changing unit increases to the maximum during the stirring operation.

By way of example, the volume changing unit 60 may be formed so that the volume of the inner space 62 changes by a so-called piston configuration. That is, as shown in FIGS. 6A and 6B, the volume changing unit 60 includes a case 65 having a substantially cylindrical shape whose axial direction is the left-right direction and a piston 66 whose left end is configured to slide on the cylindrical inner surface of the case 65 in the left-right direction and has a through hole 66*h* extending through the left end in the left-right direction at the center. The inner space 62 of the volume changing unit 60 is formed by the inner surface of the left side of the case 65, the outer surface of the left side of the left end of the piston 66, and the cylindrical inner surface of the case 65. Further, the left end of the piston 66 is biased by a coil spring 67 toward the upstream region, that is, in the left direction.

The above-mentioned volume changing unit 60 is connected to the third supply tube 28 at the left end of the case 65 and connected to the fourth supply tube 29 at the right end of the piston 66. Accordingly, the ink supplied from the upstream region flows via the third supply tube 28 into the inner space 62, and then, via the through hole 66*h* of the piston 66 and the fourth supply tube 29 into the carriage 20 (liquid ejection head 24) in the downstream region.

In the volume changing unit 60 according to this modified example, when the carriage 20 is located at the home position HP, the volume of the inner space 62 is the minimum as shown in FIG. 6A. When the carriage 20 moves from the home position HP in the right direction to the position away from the distance SK, the movement of the case 65 is regulated. As the fourth supply tube 29 that moves with the carriage 20 moves in the right direction, the piston 66 compresses the coil spring 67, which makes the volume of the inner space 62 to be the maximum as shown in FIG. 6B. Accordingly, the volume of the inner space 62 in the volume changing unit 60 changes (increases) from the minimum to the maximum.

After that, when the carriage 20 moves back to the home position HP, a compression force of the compressed coil spring 67 forces the piston 66 to move back to the initial state, and accordingly, the volume of the inner space 62 returns by itself (decreases) from the maximum to the minimum.

Since the above embodiment is configured to regulate the movement of the third supply tube 28, a tension is applied on the entire components of the liquid supplying flow channel EKR during the movement of the carriage 20. On the other hand, since this modified embodiment is configured to regulate the movement of the case 65, it is possible that a tension is applied on fewer components, for example, only the fourth supply tube 29.

Figure 7:
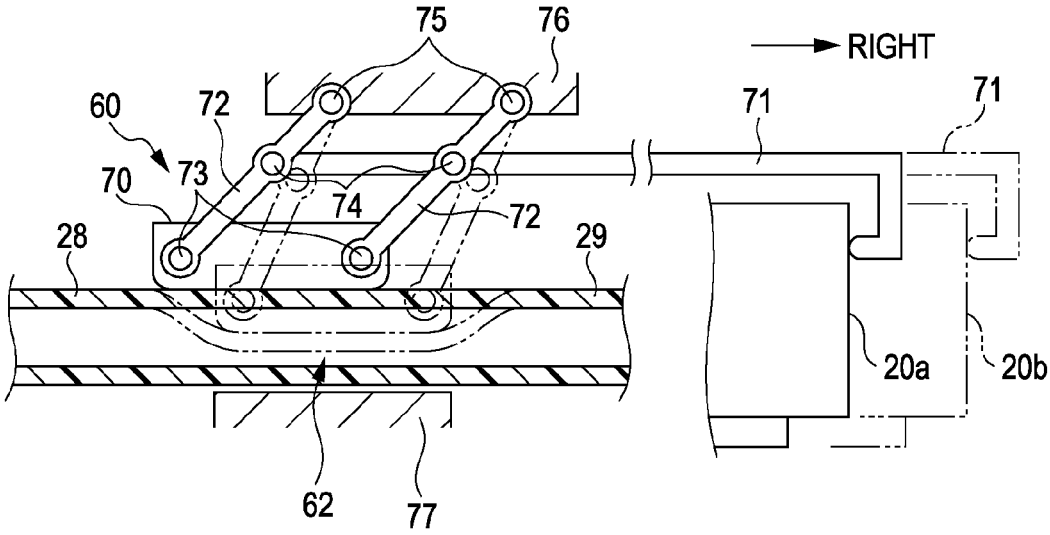
FIG. 7 is a schematic diagram of another modified example of a volume changing unit.

Alternatively, the volume changing unit 60 may be configured such that the volume of the inner space 62 is changed by squeezing the supply tube which is a component of the liquid supplying flow channel EKR. By way of example, in this modified example, either the third supply tube 28 or the fourth supply tube 29 may be formed as an elastically deformable supply tube. The volume changing unit 60 is configured such that at least one of these supply tubes is squeezed between a pressing member 70 and a receiving member 77 of the printer 11 while being pressed down by the pressing member 77 as shown in FIG. 7. Accordingly, the volume of the inner space 62 changes from the maximum to the minimum when the supply tube is pressed by the pressing member 77 as indicated by the dashed double-dotted line.

Specifically, a cooperating member 71 is provided so as to move in the right direction in accordance with the movement of the carriage 20 from the position indicated by the reference numeral 20*a* to the position indicated by the reference numeral 20*b* in FIG. 7. Further, two link members 72 are pivotally movably connected on the cooperating member 71 at connection portions 74. One end of the link member 72 is connected to a support section 76 which is formed on the printer 11 so as to pivot about a connection portion 75, while the other end is connected to the pressing member 70 so as to pivot about a connection portion 73. Accordingly, as the cooperating member 71 moves in accordance with the movement of the carriage 20 in the right direction, the two link members 72 rotate about the connection portion 75 in a direction in which the pressing member 70 presses the supply tube.

In the volume changing unit 60 according to this modified example, when the carriage 20 moves back to the home position HP, the supply tube which has been pressed down returns to the initial state by its restoring force that pushes the pressing member 70. As the supply tube restores to the initial state, the volume of the inner space 62 changes (increases) from the minimum to the maximum. Accordingly, when the volume changing unit 60 is configured to press down the component of the liquid supplying flow channel, a member for movement regulation such as the projection 80 in the above-mentioned embodiment may not be provided.

In the above-mentioned embodiment, the ink stirring operation in the stirring unit 50 may be performed when the carriage 20 moves within a range which includes a part of the printing area. In this configuration, the carriage 20 can perform the ink stirring operation before reaching the home position HP. In this case, a feature other than the projection 80 formed on the upper case may be provided in the above-mentioned embodiment, so as to regulate the movement in the right direction by abutting the third supply tube 28. For example, a drive unit may be provided to move the projection 80 in the down direction or the up direction so as to abut the third supply tube 28. This makes it possible to regulate the movement of the third supply tube 28 in the right direction by abutting the projection 80 at a position other than the home position HP.

In the above-mentioned embodiment, the stirring unit 50 and the volume changing unit 60 may be positioned at opposite positions to each other in a region downstream of the non-return valve 40 in the liquid supplying flow channel EKR, that is, the stirring unit 50 may be positioned in a region downstream of the volume changing unit 60. As is obvious from the above description, in this case, the ink stirring operation can also be performed in the same manner as that of the above-mentioned embodiment.

In the above-mentioned embodiment, the stirring unit 50 (stirring container 51) may be formed in a shape other than a cylindrical shape, such as a rectangular tubular shape, as long as the stirring unit 50 is configured such that the volume of the inner space 50A changes by the movable wall 53.

In the above-mentioned embodiment, the stirring unit 50 (stirring container 51) and the volume changing unit 60 may be formed by members other than the second supply tube 27, the third supply tube 28 and the fourth supply tube 29. As a matter of course, that the stirring unit 50 and the volume changing unit 60 may be formed by using the same member as at least one of the second supply tube 27, the third supply tube 28 and the fourth supply tube 29, or alternatively, may be formed integral with at least one of the second supply tube 27, the third supply tube 28 and the fourth supply tube 29.

In the above-mentioned embodiment, the number of liquid supplying flow channels EKR may not be limited to four, and more or less than four liquid supplying flow channels EKR may be provided. Regardless of the number of liquid supplying flow channels EKR, the movement of all the third supply tubes 28 can be simultaneously regulated by a single regulation member, that is, the projection 80, so that ink is stirred in all the liquid supplying flow channels EKR.

Although the liquid ejecting apparatus is embodied as an ink jet printer 11 in the above embodiment, liquid ejecting apparatuses that eject or dispense liquid other than ink may be used. The invention may be applied to various liquid ejecting apparatuses having a liquid ejecting head or the like that ejects fine liquid droplets. It is noted that the liquid droplets means a state of liquid that is ejected from the liquid ejecting apparatuses and are intended to include those in a particle, tear drop or string shape. Further, the liquid as described herein may be any material that can be ejected from liquid ejecting apparatuses. For example, it may include a material in liquid phase such as liquid having high or low viscosity, sol, gel water, other inorganic solvent, organic solvent and liquid solution, and a material in melted state such as liquid resin and liquid metal (molten metal). Further, in addition to a material in a liquid state, it may include particles of functional material made of solid substance such as pigment and metal particles, which is dissolved, dispersed or mixed in a solvent. Further, typical examples of liquid include ink as mentioned above, liquid crystal and the like. The ink as described herein includes various liquid components such as general water-based ink, oil-based ink, gel ink and hot melt ink. Specific examples of liquid ejecting apparatus may include, for example, liquid ejecting apparatuses that eject liquid containing materials such as electrode material and color material in a dispersed or dissolved state, which are used for manufacturing of liquid crystal displays, EL (electroluminescence) displays, surface emitting displays or color filters, liquid ejecting apparatuses that eject bioorganic materials used for manufacturing biochips, liquid ejecting apparatuses that are used as a precision pipette and eject liquid of a sample, textile printing apparatuses and micro dispensers. Further, examples of fluid ejecting apparatus may also include liquid ejecting apparatuses that eject lubricant to precision instrument such as a clock or camera in a pinpoint manner, liquid ejecting apparatuses that eject transparent resin liquid such as ultraviolet cured resin onto a substrate for manufacturing of minute hemispheric lenses (optical lenses) used for optical communication elements or the like, and liquid ejecting apparatuses that eject acid or alkali etching liquid for etching a substrate or the like. The invention may be applied to any one of the above-mentioned liquid ejecting apparatuses.

The entire disclosure of Japanese Patent Application No. 2011-022794, filed Feb. 4, 2011 is expressly incorporated by reference herein.

What is claimed is:

1. A liquid ejecting apparatus comprising:

a liquid ejection head that reciprocates and ejects a liquid therefrom;

a liquid supplying flow channel that causes the liquid to move so as to supply the liquid to the liquid ejection head;

a non-return valve that opens when the liquid flows from an upstream region to a downstream region where the liquid ejection head is located and closes when the liquid flows from the downstream region to the upstream region, the non-return valve being disposed in the course of the liquid supplying flow channel;

a volume changing unit that changes a volume of an inner space in accordance with the movement of the liquid ejection head, the volume changing unit being disposed in the liquid supplying flow channel between the non-return valve and the liquid ejection head; and a stirring unit that stirs the liquid stored therein in accordance with the volume change of the inner space of the volume changing unit, the stirring unit being disposed in the liquid supplying flow channel between the volume changing unit and the non-return valve.

2. The liquid ejecting apparatus according to claim 1, wherein the liquid ejection head is capable of moving between a medium ejection area in which the liquid is ejected from the liquid ejection head onto the medium and a non-medium ejection area other than the medium ejection area, and the volume changing unit changes the volume of the inner space of the volume changing unit when the liquid ejection head moves in the non-medium ejection area.

3. The liquid ejecting apparatus according to claim 1, wherein the stirring unit includes a movable wall that moves in accordance with the volume change of the inner space of the volume changing unit so as to change the volume of the liquid stored in the stirring unit.

4. The liquid ejecting apparatus according to claim 3, wherein the movable wall is regulated so that the volume of the liquid stored in the stirring unit does not fall below a predetermined volume when the movable wall moves in a direction in which the volume of the liquid decreases.

5. The liquid ejecting apparatus according to claim 3, further comprising a biasing unit that biases the movable wall in a direction in which the volume of the liquid stored in the stirring unit decreases.

6. The liquid ejecting apparatus according to claim 1, further comprising a check valve that prevents the liquid from flowing between the liquid ejection head and the liquid supplying flow channel when the volume of the inner space of the volume changing unit changes, the check valve being disposed in the liquid supplying flow channel.

7. The liquid ejecting apparatus according to claim 1, wherein the volume changing unit has a bellows and the volume of the inner space of the volume changing unit changes when the bellows expands/collapses.

* * * * *